US010504433B2

(12) United States Patent
Kim et al.

(10) Patent No.: US 10,504,433 B2
(45) Date of Patent: Dec. 10, 2019

(54) PIXEL AND ORGANIC LIGHT EMITTING DISPLAY DEVICE INCLUDING THE SAME

(71) Applicant: SAMSUNG DISPLAY CO., LTD., Yongin-si, Gyeonggi-do (KR)

(72) Inventors: Ji Tae Kim, Yongin-si (KR); Hyung Min Shin, Yongin-si (KR); Kyung Ho Hwang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 103 days.

(21) Appl. No.: 15/241,192

(22) Filed: Aug. 19, 2016

(65) Prior Publication Data

US 2017/0110048 A1 Apr. 20, 2017

(30) Foreign Application Priority Data

Oct. 20, 2015 (KR) ..... 10-2015-0146007

(51) Int. Cl.

*G09G 5/10* (2006.01)
*G09G 3/325* (2016.01)
*G09G 3/3283* (2016.01)

(52) U.S. Cl.

CPC ..... *G09G 3/325* (2013.01); *G09G 3/3283* (2013.01); *G09G 2300/0426* (2013.01); *G09G 2300/0814* (2013.01); *G09G 2300/0819* (2013.01); *G09G 2300/0842* (2013.01); *G09G 2310/0297* (2013.01)

(58) Field of Classification Search

None

See application file for complete search history.

(56) References Cited

U.S. PATENT DOCUMENTS

2006/0267885 A1* 11/2006 Kwak ..... G09G 3/3233 345/76
2007/0040770 A1* 2/2007 Kim ..... G09G 3/3233 345/76
2007/0126665 A1* 6/2007 Kimura ..... G09G 3/3233 345/76
2012/0001896 A1* 1/2012 Han ..... G09G 3/3233 345/214

(Continued)

FOREIGN PATENT DOCUMENTS

JP 2007041571 A * 2/2007
KR 10-0570995 B1 4/2006

OTHER PUBLICATIONS

Wikipedia definition of capacitor, https://en.wikipedia.org/wiki/Capacitor, p. 1.*

(Continued)

*Primary Examiner* — Lunyi Lao
*Assistant Examiner* — Kirk W Hermann
(74) *Attorney, Agent, or Firm* — Lewis Roca Rothgerber Christie LLP

(57) ABSTRACT

A pixel includes a pixel circuit and a storage circuit. The pixel circuit provides a driving current corresponding to a data signal to an organic light emitting diode. The storage circuit provides the data signal to the pixel circuit. The storage circuit includes a storage capacitor to store the data signal and a control transistor to transmit a data signal supplied from a data output line to the storage capacitor when the control transistor is turned on.

18 Claims, 9 Drawing Sheets

(56) References Cited

U.S. PATENT DOCUMENTS

2012/0306840 A1* 12/2012 Han ..... G09G 3/003
345/212
2014/0198067 A1* 7/2014 Jeon ..... G06F 3/0416
345/173

OTHER PUBLICATIONS

Wikipedia definition of capacitor, 2018, https://en.wikipedia.org/wiki/Capacitor, p. 1 (Year: 2018).*

* cited by examiner

Ek
PC2'
111
ELVDD
Cp2
Tp11
N4
Tp7
N5
Tp12
Tp9
Tp10
Ta2
N6
Tp8
OLED2
112
ELVSS
113
VINT
PXL2'
50
Td2
D2
01
PC1'
111
ELVDD
Cp1
Tp5
N1
Tp1
N2
Tp6
Tp3
Tp4
Ta1
N3
Tp2
OLED1
112
ELVSS
113
VINT
PXL1'
Cs1
SC1
Tc1
Td1
D1
90
221
Cd1
Cd2
222
Sk
Sk-1
Sk+1

PIXEL AND ORGANIC LIGHT EMITTING DISPLAY DEVICE INCLUDING THE SAME

CROSS-REFERENCE TO RELATED APPLICATION

Korean Patent Application No. 10-2015-0146007, filed on Oct. 20, 2015, and entitled, "Pixel and Organic Light Emitting Display Device Including the Same," is incorporated by reference herein in its entirety.

BACKGROUND

1. Field

One or more embodiments described herein relate to a pixel and an organic light emitting display device including one or more pixels.

2. Description of the Related Art

Display apparatuses allow users to access information. Examples of display apparatus include liquid crystal displays and organic light emitting displays. These displays may include a data driver for supplying data signals to data lines, a scan driver for supplying scan signals to scan lines, and a plurality of pixels connected to the scan lines and the data lines.

In an attempt to reduce manufacturing costs, some displays have been equipped with demultiplexers. The demultiplexers receive data signals through output lines of their data drivers and time-divisionally output the data signals to data lines. The number of data lines is therefore greater than the number of output lines.

SUMMARY

In accordance with one or more embodiments, a pixel includes an organic light emitting diode (OLED); a pixel circuit to provide a driving current corresponding to a data signal to the OLED; and a storage circuit to provide the data signal to the pixel circuit, wherein the storage circuit includes: a storage capacitor to store the data signal; and a control transistor to transmit a data signal supplied from a data output line to the storage capacitor when the control transistor is turned on. The control transistor may have a first electrode connected to the data output line and a second electrode connected to the pixel circuit, and the storage capacitor may be connected to the second electrode of the control transistor.

The pixel circuit may include a first pixel transistor connected between a first node and a second node and having a gate electrode connected to a third node; a second pixel transistor connected between the second electrode of the control transistor and the first node; a third pixel transistor connected between the second node and the third node; a fourth pixel transistor connected between the third node and an initializing power source; a fifth pixel transistor connected between the first node and a first power source; a sixth pixel transistor connected between the second node and the OLED; and a pixel capacitor connected between the first power source and the third node. The OLED may include an anode electrode connected to the sixth pixel transistor, and a cathode electrode connected to a second power source.

A gate electrode of the control transistor and a gate electrode of the fourth pixel transistor may be connected to a same first scan line, a gate electrode of the second pixel transistor and a gate electrode of the third pixel transistor may be connected to a same second scan line, and a gate electrode of the fifth pixel transistor and a gate electrode of the sixth pixel transistor may be connected to a same emission control line. The pixel circuit may include a seventh pixel transistor connected between the initializing power source and the anode electrode of the OLED.

The gate electrode of the control transistor and the gate electrode of the fourth pixel transistor may be connected to a same first scan line, the gate electrode of the second pixel transistor and the gate electrode of the third pixel transistor may be connected to a same second scan line, the gate electrode of the seventh pixel transistor is connected to a third scan line, and the gate electrode of the fifth pixel transistor and gate electrode of the sixth pixel transistor may be connected to a same emission control line.

In accordance with one or more additional embodiments, an organic light emitting display device includes a first pixel connected to a first data output line, an emission control line, a first scan line, and a second scan line; a second pixel connected to a second data output line, the emission control line, the first scan line, and the second scan line; an emission control driver to supply an emission control signal to the emission control line; a scan driver to respectively supply a first scan signal and a second scan signal to the first scan line and the second scan line; a data driver to supply a first data signal and a second data signal to a data input line; and a demultiplexer to respectively transmit the first data signal and the second data signal from the data input line to the first data output line and the second data output line.

The first pixel includes a first OLED; a first pixel circuit to supply a driving current corresponding to the first data signal to the first OLED; a first storage capacitor to store the first data signal and to supply the first data signal to the first pixel circuit; and a first control transistor connected to the first data output line and to transmit the first data signal supplied from the first data output line to the first storage capacitor when the first control transistor is turned on. The first control transistor may have a first electrode connected to the first data output line and a second electrode connected to the first pixel circuit, and the first storage capacitor may be connected to the second electrode of the first control transistor.

The first pixel circuit may include a first pixel transistor connected between a first node and a second node and having a gate electrode connected to a third node; a second pixel transistor connected between the second electrode of the first control transistor and the first node; a third pixel transistor connected between the second node and the third node; a fourth pixel transistor connected between the third node and an initializing power source; a fifth pixel transistor connected between the first node and a first power source; a sixth pixel transistor connected between the second node and the first OLED; and a first pixel capacitor connected between the first power source and the third node. The second pixel may include a second OLED; and a second pixel circuit connected to the second data output line, the second pixel circuit to receive the second data signal and to supply a driving current corresponding to the second data signal to the second OLED.

The second pixel circuit may include a seventh pixel transistor connected between a fourth node and a fifth node and having a gate electrode connected to a sixth node; an eighth pixel transistor connected between the second data output line and the fourth node; a ninth pixel transistor connected between the fifth node and the sixth node; a tenth pixel transistor connected between the sixth node and the initializing power source; an eleventh pixel transistor connected between the fourth node and the first power source;

a twelfth pixel transistor connected between the fifth node and the OLED; and a second pixel capacitor connected between the first power source and sixth node.

A gate electrode of the first control transistor, a gate electrode of the fourth pixel transistor, and a gate electrode of the tenth pixel transistor may be connected to a same first scan line, a gate electrode of the second pixel transistor, a gate electrode of the third pixel transistor, a gate electrode of the eighth pixel transistor, and a gate electrode of the ninth pixel transistor may be connected to a same second scan line, and a gate electrode of the fifth pixel transistor, a gate electrode of the sixth pixel transistor, a gate electrode of the eleventh pixel transistor, and a gate electrode of the twelfth pixel transistor may be connected to a same emission control line.

The demultiplexer may include a first data transistor connected between the data input line and the first data output line and turned on in response to a first data control signal; and a second data transistor connected between the data input line and the second data output line and turned on in response to a second data control signal.

The emission control signal may be supplied in a first period, a second period, and a third period, the first scan signal may be supplied in the first period, the second scan signal may be supplied in the third period, the first data control signal may be supplied in a partial period in the first period, and the second data control signal may be supplied in a partial period in the second period and a partial period in the third period.

The second pixel may include a second OLED; a second pixel circuit to supply a driving current corresponding to the second data signal to the second OLED; a second storage capacitor to store the second data signal and to supply the second data signal to the second pixel circuit; and a second control transistor connected to the second data output line and to transmit the second data signal from the second data output line to the second storage capacitor when the second control transistor is turned on.

The second pixel circuit may include a seventh pixel transistor connected between a fourth node and a fifth node and having a gate electrode connected to a sixth node; an eighth pixel transistor connected between a second electrode of the second control transistor and the fourth node; a ninth pixel transistor connected between the fifth node and the sixth node; a tenth pixel transistor connected between the sixth node and the initializing power source; an eleventh pixel transistor connected between the fourth node and the first power source; a twelfth pixel transistor connected between the fifth node and the OLED; and a second pixel capacitor connected between the first power source and the sixth node.

A gate electrode of the first control transistor, a gate electrode of the fourth pixel transistor, a gate electrode of the second control transistor, and a gate electrode of the tenth pixel transistor may be connected to a same first scan line, a gate electrode of the second pixel transistor, a gate electrode of the third pixel transistor, a gate electrode of the eighth pixel transistor, and a gate electrode of the ninth pixel transistor may be connected to a same second scan line, and a gate electrode of the fifth pixel transistor, a gate electrode of the sixth pixel transistor, a gate electrode of the eleventh pixel transistor, and a gate electrode of the twelfth pixel transistor may be connected to a same emission control line.

The demultiplexer may include a first data transistor connected between the data input line and the first data output line and turned on in response to a first data control signal; and a second data transistor connected between the data input line and the second data output line and turned on in response to a second data control signal.

The emission control signal may be supplied in a first period and a second period, the first scan signal may be supplied in the first period, the second scan signal may be supplied in the second period, the first data control signal may be supplied in a first sub-period in the first period, and the second data control signal may be supplied in a second sub-period in the first period.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
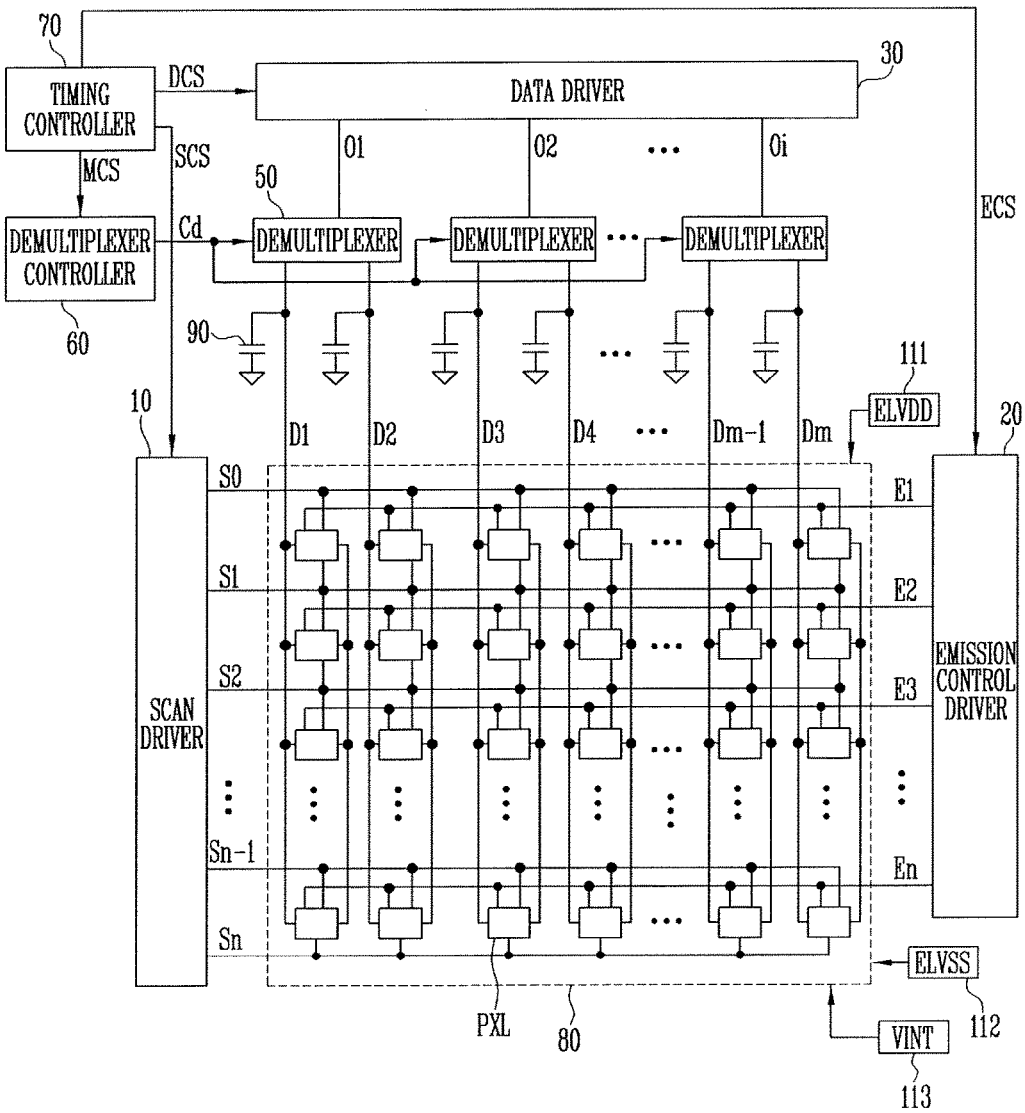
FIG. 1 illustrates an embodiment of an organic light emitting display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

It will be understood that when an element is referred to as being "connected to" another element, it can be directly connected to the element or it can be electrically connected to the element with one or more intervening elements interposed. In addition, in the drawings, parts that are not related to the present invention are omitted in order to clarify the present invention. Like reference numerals refer to like elements throughout.

FIG. 1 illustrates an embodiment of an organic light emitting display device which includes a plurality of pixels PXL, a scan driver 10, an emission control driver 20, a data driver 30, demultiplexers 50, a demultiplexer controller 60, and a timing controller 70. The pixels PXL may be connected to a plurality of scan lines S0 to Sn and data output lines D1 to Dm. In addition, the pixels PXL may be connected to emission control lines E1 to En.

The connection relationship among the pixels PXL, the scan lines S0 to Sn, the data output lines D1 to Dm, and the emission control lines E1 to En may vary in different embodiments. For example, each pixel PXL may be connected to one data output line, one emission control line, and a plurality of scan lines.

The pixels PXL are connected to a first power source 111 and a second power source 112 and may receive a first voltage ELVDD and a second voltage ELVSS from the first power source 111 and the second power source 112. In addition, the pixels PXL are connected to an initializing power source 113 and may receive an initializing voltage VINT from the initializing power source 113.

Each of the pixels PXL may generate light corresponding to a data signal based on current that flows from the first power source 111 to the second power source 112 via an organic light emitting diode (OLED).

The scan driver 10 generates the scan signals under control of the timing controller 70 and supplies the generated scan signals to the scan lines S0 to Sn. Therefore, the pixels PXL respectively receive the scan signals through the scan lines S0 to Sn.

The emission control driver 20 generates emission control signals by control of the timing controller 70 and may supply the generated emission control signals to the emission control lines E1 to En. Therefore, the pixels PXL may respectively receive the emission control signals through the emission control lines E1 to En.

In FIG. 1, the emission control driver 20 is illustrated as being separate from the scan driver 10. However, the emission control driver 20 may be integrated with the scan driver 10 in another embodiment. In addition, according to another embodiment, the emission control driver 20 and the emission control lines E1 to En may be omitted.

The data driver 30 generates the data signals under control of the timing controller 70 and supplies the generated data signals to data input lines O1 to Oi. For example, the data driver 30 may supply the data signals to the demultiplexers 50 through the data input lines O1 to Oi. In FIG. 1, the number of data input lines O1 to Oi is illustrated as being half the number of data output lines D1 to Dm. However, the ratio of data input lines O1 to Oi to data output lines D1 to Dm may be different in another embodiment, for example, based on the structures of the demultiplexers 50.

The demultiplexers 50 receive the data signals from the data driver 30 and may supply the data signals to the data output lines D1 to Dm. For example, the demultiplexers 50 receive the data signals through the data input lines O1 to Oi and may time-divisionally output the data signals to the data output lines D1 to Dm. The number of data lines D1 to Dm may be greater than the number of data input lines O1 to Oi. The pixels PXL respectively receive the data signals through the data output lines D1 to Dm.

In order to store signals and voltages applied to the data output lines D1 to Dm, a capacitor 90 may be coupled to each of the data output lines D1 to Dm. The capacitors 90 may be formed, for example, by parasitic capacitance that exists in a wiring line. In another embodiment, the capacitors 90 may be physically provided in the data output lines D1 to Dm.

The demultiplexer controller 60 may control operations of the demultiplexers 50 based on a data control signal Cd. For example, the data control signal Cd may control operations of transistors respectively included in the demultiplexers 50. The demultiplexer controller 60 receives a demultiplexer control signal MCS from the timing controller 70 and generates the data control signal Cd corresponding to the demultiplexer control signal MCS. In FIG. 1, the demultiplexer controller 60 is illustrated as being separate from the timing controller 70. In another embodiment, the demultiplexer controller 60 may be integrated with the timing controller 70.

The timing controller 70 may control the scan driver 10, the emission control driver 20, the data driver 30, and the demultiplexer controller 60. The timing controller 70 may respectively supply a scan driver control signal SCS and an emission control driver control signal ECS to the scan driver 10 and the emission control driver 20. In addition, the timing controller 70 may respectively supply a data driver control signal DCS and the demultiplexer control signal MCS to the data driver 30 and the demultiplexer controller 60.

In FIG. 1, for convenience sake, the scan driver 10, the emission control driver 20, the data driver 30, the demultiplexer controller 60, and the timing controller 70 are illustrated as being separate from each other. In another embodiment, two or more of these may be integrated with each other.

The first power source 111 and the second power source 112 may provide the power source voltages ELVDD and ELVSS to the pixels PXL in a pixel unit 80. For example, the first voltage ELVDD from the first power source 111 may be a high voltage and the second voltage ELVSS from the second power source 112 may be a low voltage. In one embodiment, the first voltage ELVDD is a positive voltage and the second voltage ELVSS is a negative voltage or a ground voltage.

The initializing power source 113 may provide the initializing voltage VINT to the pixels PXL in the pixel unit 80. In one embodiment, the initializing voltage VINT may be lower than the data signal.

Figure 2:
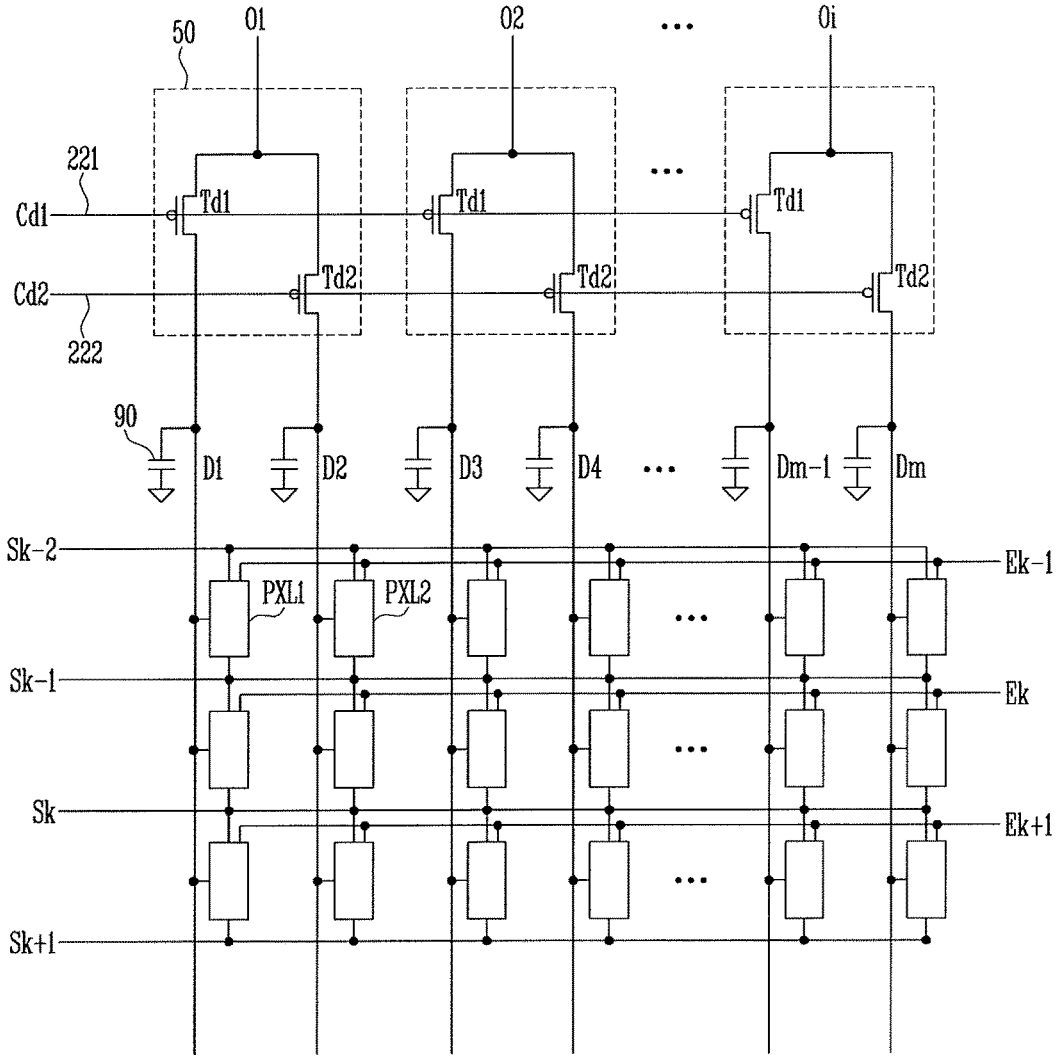
FIG. 2 illustrates an embodiment of a demultiplexer.

FIG. 2 illustrates an embodiment of a demultiplexer, which, for example, may be representative of demultiplexers 50 connected to the first data input line O1, the first data output line D1, and the second data output line D2 in FIG. 1. Pixels connected to the first data output line D1 may be referred to as first pixels PXL1 and pixels connected to the second data output line D2 may be referred to as second pixels PXL2.

The pixels connected to each demultiplexer 50 may have, for example, a pentile-type structure. For example, the first pixels PXL1 connected to the first data output line D1 may emit light of a first color and the second pixels PXL2 connected to the second data output line D2 may emit light of a second color and a third color. The first color, the second color, and the third color may be, for example, green, red, and blue, respectively, or another combination of colors. In another embodiment, the first pixels PXL1 connected to the first data output line D1 may emit light of the second color and light of the third color and the second pixels PXL2 connected to the second data output line D2 may emit light of the first color.

Referring to FIG. 2, the demultiplexer 50 includes a first data transistor Td1 and a second data transistor Td2. The first data transistor Td1 may be connected between the first data input line O1 and the first data output line D1. The first data transistor Td1 may be turned on based on a first data control signal Cd1. For example, the first data transistor Td1 may include a first electrode connected to the first data input line O1, a second electrode connected to the first data output line D1, and a gate electrode connected to a first data control line 221.

The first data control line 221 receives the first data control signal Cd1 from the demultiplexer controller 60 and may transmit the first data control signal Cd1 to the first data transistor Td1. For example, when the first data control signal Cd1 is supplied to the first data control line 221, the first data transistor Td1 is turned on so that a first data signal output from the data driver 30 may be supplied to the first data output line D1 through the first data transistor Td1.

The second data transistor Td2 may be connected between the first data input line O1 and the second data output line D2. In addition, the second data transistor Td2 may be turned on based on a second data control signal Cd2. For example, the second data transistor Td2 may include a first electrode connected to the first data input line O1, a second electrode connected to the second data output line D2, and a gate electrode connected to a second data control line 222.

The second data control line 222 receives the second data control signal Cd2 from the demultiplexer controller 60 and may transmit the second data control signal Cd2 to the second data transistor Td2. For example, when the second data control signal Cd2 is supplied to the second data control line 222, the second data transistor Td2 is turned on so that a second data signal output from the data driver 30 may be supplied to the second data output line D2 through the second data transistor Td2.

As illustrated in FIG. 2, the first data transistor Td1 and the second data transistor Td2 may be p-type transistors. In another embodiment, the first data transistor Td1 and the second data transistor Td2 may be n-type transistors.

Figure 3:
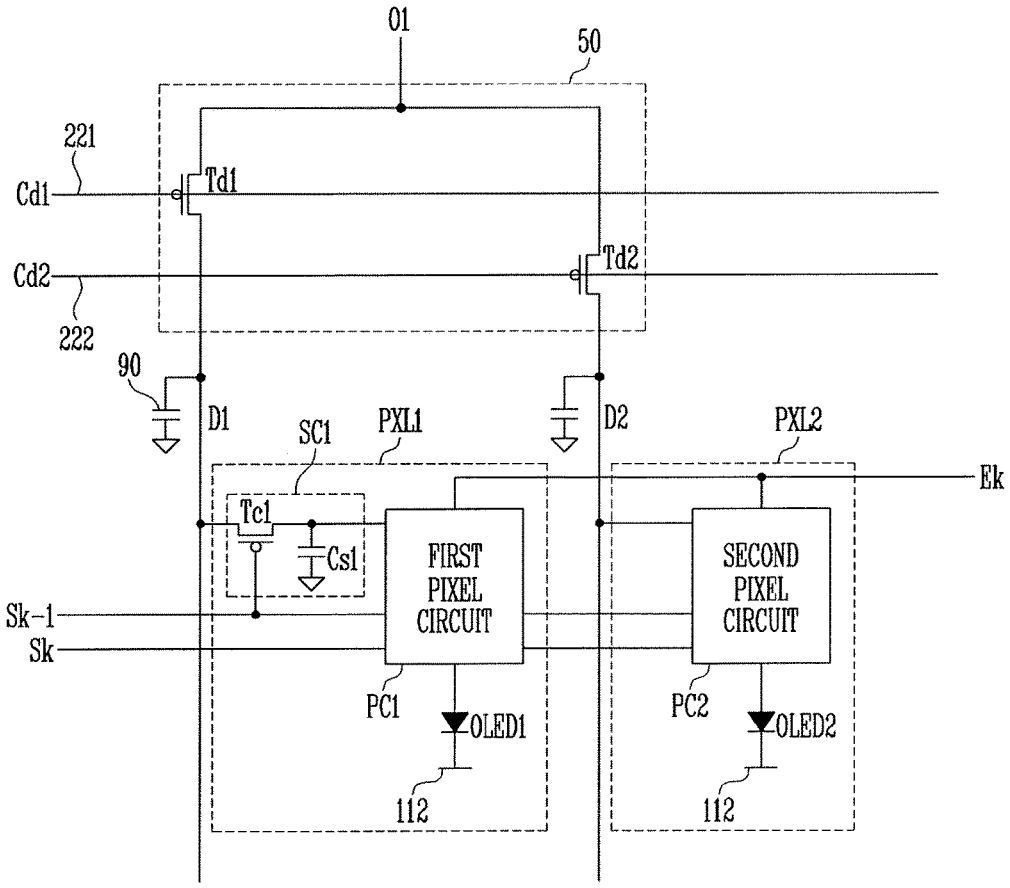
FIG. 3 illustrates an embodiment including multiple pixels.

FIG. 3 illustrates an embodiment which includes a first pixel PXL1 and a second pixel PXL2. In FIG. 3, for convenience sake, only the pixels PXL1 and PXL2 connected to a (k−1)th scan line Sk−1, a kth scan line Sk, a kth emission control line Ek, the first data output line D1, and the second data output line D2 are illustrated.

The first pixel PXL1 may include a first OLED OLED1, a first pixel circuit PC1, and a first storage circuit SC1. The first OLED OLED1 receives a driving current from the first pixel circuit PC1 and emits light with brightness corresponding to the driving current. For example, the first OLED OLED1 may be connected between the first pixel circuit PC1 and the second power source 112.

The first pixel circuit PC1 may supply the driving current corresponding to the first data signal to the first OLED OLED1. For example, the first pixel circuit PC1 may operate by using a scan signal supplied from the (k−1)th scan line Sk−1, a scan signal supplied from the kth scan line Sk, and an emission control signal supplied from the kth emission control line Ek.

The first storage circuit SC1 is connected to the first data output line D1 and may transmit the first data signal supplied by the first data output line D1 to the first pixel circuit PC1. For example, the first storage circuit SC1 may include a first storage capacitor Cs1 and a first control transistor Tc1. The first storage capacitor Cs1 stores the first data signal and may supply the first data signal to the first pixel circuit PC1.

The first control transistor Tc1 is connected to the first data output line D1 and may transmit the first data signal from the first data output line D1 to the first storage capacitor Cs1 when the first control transistor Tc1 is turned on. For example, on and off operations of the first control transistor Tc1 may be controlled by the scan signal supplied from the (k−1)th scan line Sk−1.

The first control transistor Tc1 has a first electrode connected to the first data output line D1, a second electrode connected to the first storage capacitor Cs1 and the first pixel circuit PC1, and a gate electrode connected to (k−1)th scan line Sk−1. The first and second electrodes of a transistor may be source and drain electrodes or vice versa.

The second pixel PXL2 may include a second OLED OLED2 and a second pixel circuit PC2. The second OLED OLED2 receives a driving current from the second pixel circuit PC2 and emits light with brightness corresponding to the driving current. For example, the second OLED OLED2 may be connected between the second pixel circuit PC2 and the second power source 112. The second pixel circuit PC2 may supply a driving current corresponding to the second data signal to the second OLED OLED2.

Since the second pixel PXL2 does not include a storage circuit SC1 unlike the first pixel PXL1, the second pixel circuit PC2 may directly receive the second data signal through the second data output line D2. For example, the second pixel circuit PC2 is connected to the second data output line D2 and may receive the second data signal from the second data output line D2. In one embodiment, the second pixel circuit PC2 may operate based on the scan signal from the (k−1)th scan line Sk−1, the scan signal from the kth scan line Sk, and the emission control signal from the kth emission control line Ek.

Figure 4:
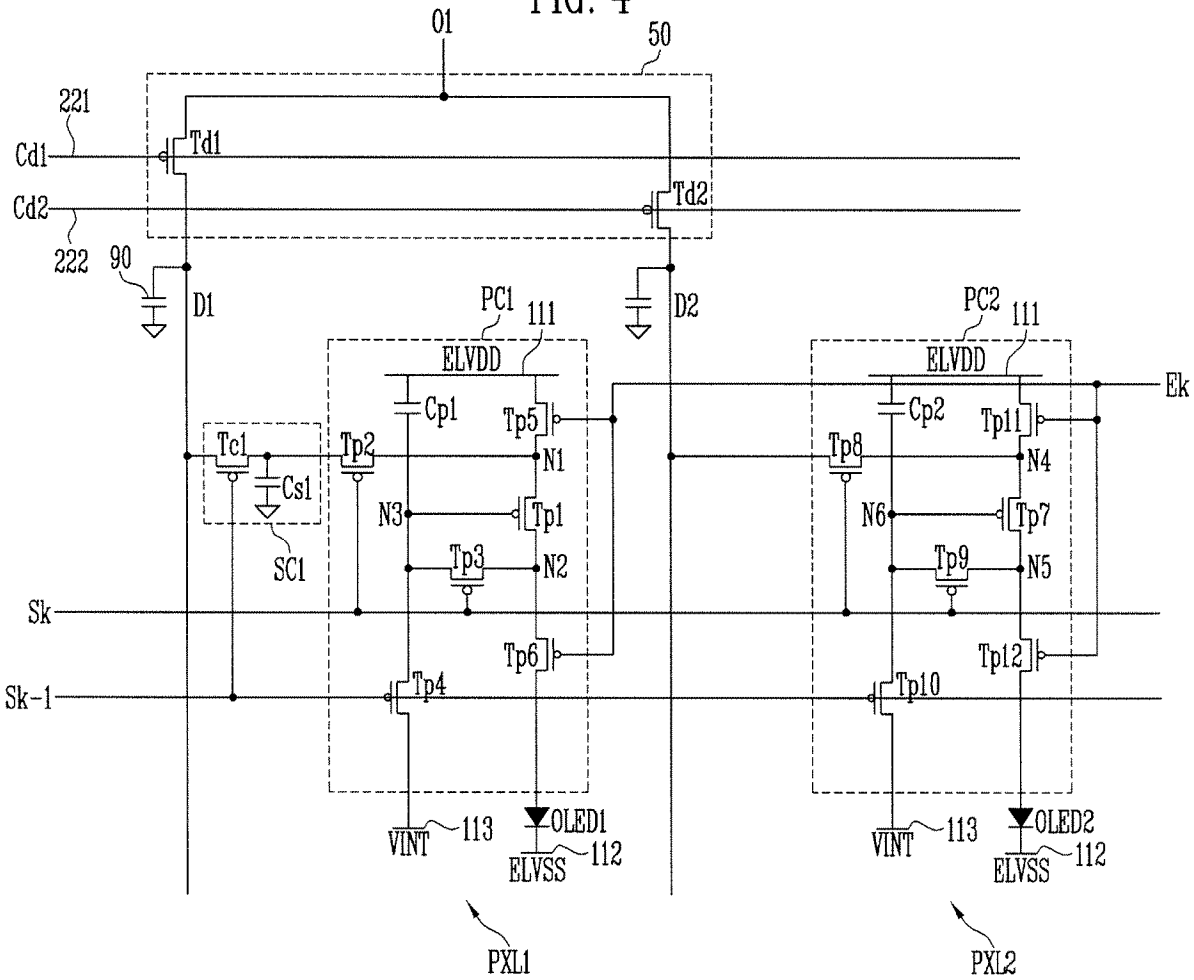
FIG. 4 illustrates an embodiment of pixel circuits.

FIG. 4 illustrates an embodiment of pixel circuits, which may be representative of the pixel circuits in FIG. 3. Referring to FIG. 4, the first pixel circuit PC1 may include a plurality of pixel transistors Tp1 to Tp6 and a first pixel capacitor Cp1. The first pixel transistor Tp1 is connected between a first node N1 and a second node N2 and may have a gate electrode connected to a third node N3. For example, the first pixel transistor Tp1 may include a first electrode connected to the first node N1, a second electrode connected to the second node N2, and the gate electrode connected to the third node N3.

The second pixel transistor Tp2 may be connected between the first control transistor Tc1 in the first storage circuit SC1 and the first node N1. For example, the second pixel transistor Tp2 may include a first electrode connected to a second electrode of the first control transistor Tel, a second electrode connected to the first node N1, and a gate electrode connected to the kth scan line Sk.

The third pixel transistor Tp3 may be connected between the second node N2 and the third node N3. For example, the third pixel transistor Tp3 may include a first electrode connected to the third node N3, a second electrode connected to the second node N2, and a gate electrode connected to the kth scan line Sk.

The fourth pixel transistor Tp4 may be connected between the third node N3 and the initializing power source 113. For example, the fourth pixel transistor Tp4 may include a first electrode connected to third node N3, a second electrode connected to initializing power source 113, and a gate electrode connected to (k−1)th scan line Sk−1.

The fifth pixel transistor Tp5 may be connected between the first node N1 and the first power source 111. For example, the fifth pixel transistor Tp5 may include a first electrode connected to the first power source 111, a second electrode connected to the first node N1, and a gate electrode connected to the kth emission control line Ek.

The sixth pixel transistor Tp6 may be connected between the second node N2 and the first OLED OLED1. For example, the sixth pixel transistor Tp6 may include a first electrode connected to the second node N2, a second electrode connected to an anode electrode of the first OLED OLED1, and a gate electrode connected to the kth emission control line Ek.

The first pixel capacitor Cp1 may be connected between the first power source 111 and the third node N3. For example, the first pixel capacitor Cp1 may include a first electrode connected to the first power source 111 and a second electrode connected to the third node N3.

The first OLED OLED1 may include the anode electrode connected to the second electrode of the sixth pixel transistor Tp6, a cathode electrode connected to the second power source 112, and a light emitting layer between the anode electrode and the cathode electrode. In one embodiment, the second pixel circuit PC2 may include a plurality of pixel transistors Tp7 to Tp12 and a second pixel capacitor Cp2.

The seventh pixel transistor Tp7 is connected between a fourth node N4 and a fifth node N5 and may have a gate electrode connected to a sixth node N6. For example, the seventh pixel transistor Tp7 may include a first electrode connected to the fourth node N4, a second electrode connected to the fifth node N5, and a gate electrode connected to the sixth node N6.

The eighth transistor Tp8 may be connected between the second data output line D2 and the fourth node N4. For example, the eighth pixel transistor Tp8 may include a first electrode connected to the second data output line D2, a second electrode connected to the fourth node N4, and a gate electrode connected to the kth scan line Sk.

The ninth pixel transistor Tp9 may be connected between the fifth node N5 and the sixth node N6. For example, the ninth pixel transistor Tp9 may include a first electrode connected to the sixth node N6, a second electrode connected to the fifth node N5, and a gate electrode connected to the kth scan line Sk.

The tenth pixel transistor Tp10 may be connected between the sixth node N6 and initializing power source 113. For example, the tenth pixel transistor Tp10 may include a first electrode connected to sixth node N6, a second electrode connected to the initializing power source 113, and a gate electrode connected to (k−1)th scan line Sk−1.

The eleventh pixel transistor Tp11 may be connected between the fourth node N4 and the first power source 111. For example, the eleventh pixel transistor Tp11 may include a first electrode connected to the first power source 111, a second electrode connected to the fourth node N4, and a gate electrode connected to the kth emission control line Ek.

The twelfth pixel transistor Tp12 may be connected between the fifth node N5 and the second OLED OLED2. For example, the twelfth pixel transistor Tp12 may include a first electrode connected to the fifth node N5, a second electrode connected to an anode electrode of the second OLED OLED2, and a gate electrode connected to the kth emission control line Ek.

The second pixel capacitor Cp2 may be connected between the first power source 111 and the sixth node N6. For example, the second pixel capacitor Cp2 may include a first electrode connected to the first power source 111 and a second electrode connected to the sixth node N6.

The second OLED OLED2 may include the anode electrode connected to the second electrode of the twelfth pixel transistor Tp12, a cathode electrode connected to the second power source 112, and a light emitting layer positioned between the anode electrode and the cathode electrode.

Through the above-described structure, the gate electrode of the first control transistor Tc1, the gate electrode of the fourth pixel transistor Tp4, and the gate electrode of the tenth pixel transistor Tp10 may be connected to the same first scan line (for example, the (k−1)th scan line Sk−1).

In addition, the gate electrode of the second pixel transistor Tp2, the gate electrode of the third pixel transistor Tp3, the gate electrode of the eighth pixel transistor Tp8, and the gate electrode of the ninth pixel transistor Tp9 may be connected to the same second scan line (for example, the kth scan line Sk).

In addition, the gate electrode of the fifth pixel transistor Tp5, the gate electrode of the sixth pixel transistor Tp6, the gate electrode of the eleventh pixel transistor Tp11, and the gate electrode of the twelfth pixel transistor Tp12 may be connected to the same emission control line (for example, the kth emission control line Ek).

Figure 5:
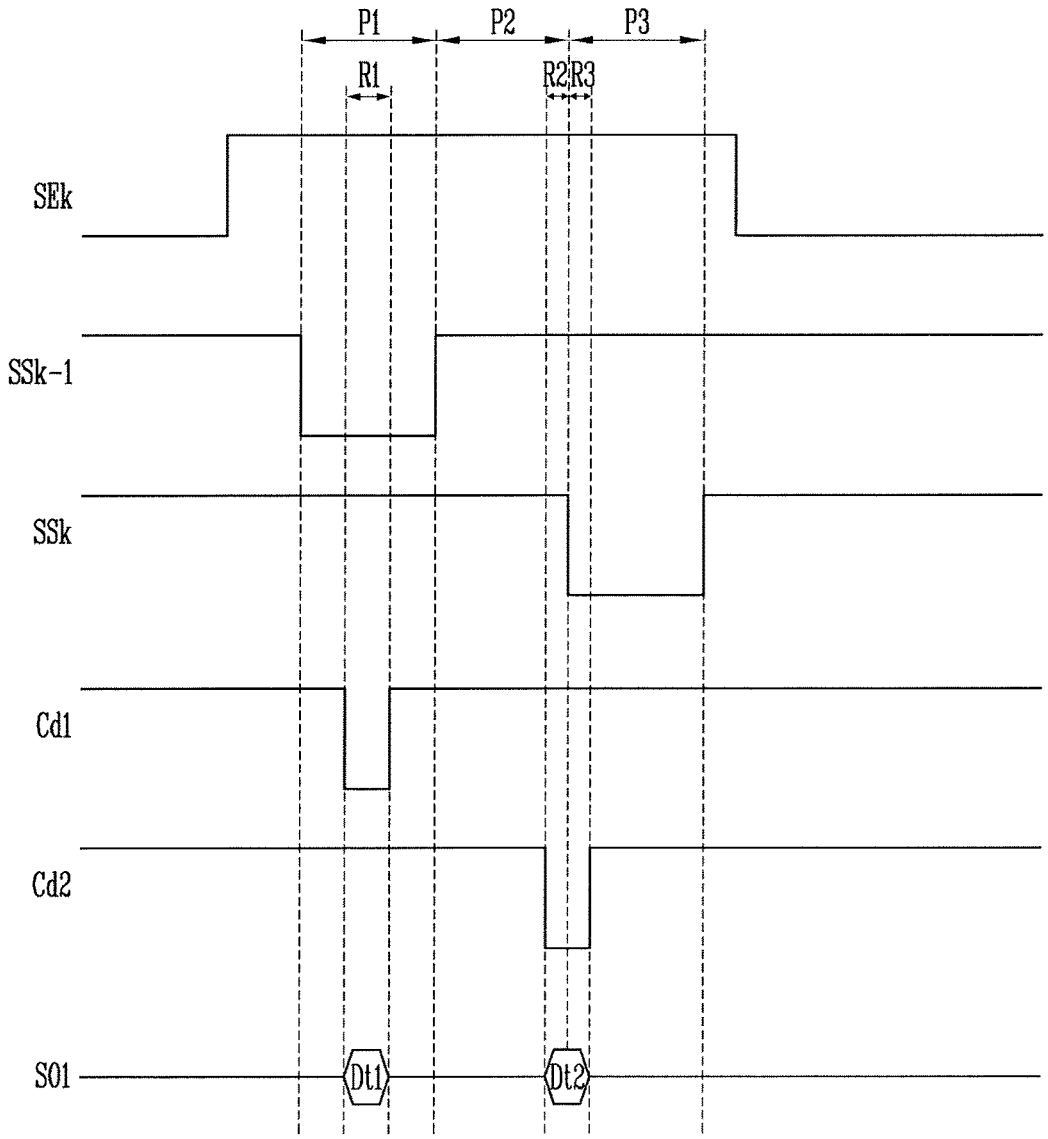
FIG. 5 illustrates an embodiment of a waveform diagram for a display device.

FIG. 5 illustrates an embodiment of a waveform diagram for an organic light emitting display device, which, for example, may correspond to any of the embodiments described herein.

Referring FIG. 5, the waveform diagram includes an emission control signal SEk supplied to the kth emission control line Ek, a first scan signal SSk−1 supplied to the (k−1)th scan line Sk−1, a second scan signal SSk supplied to the kth scan line Sk, the first data control signal Cd1, the second data control signal Cd2, and a signal SO1 supplied to the first data input line O1.

The emission control signal SEk may have a voltage to turn off a transistor. For example, when the transistor that receives the emission control signal SEk is a p-type transistor, the emission control signal SEk may have a high level voltage. When the transistor which receives the emission control signal SEk is an n-type transistor, the emission control signal SEk may have a low level voltage.

The scan signals SSk−1 and SSk and the data control signals Cd1 and Cd2 may have voltages which turn on a transistor. For example, when the transistor that receives the scan signals SSk−1 and SSk and the data control signals Cd1 and Cd2 is a p-type transistor, the scan signals SSk−1 and SSk and the data control signals Cd1 and Cd2 may have low level voltages.

When the transistor that receives the scan signals SSk−1 and SSk and the data control signals Cd1 and Cd2 is an n-type transistor, the scan signals SSk−1 and SSk and the data control signals Cd1 and Cd2 may have high level voltages.

The emission control signal SEk may be supplied in a first period P1, a second period P2, and a third period P3. For example, supply of the emission control signal SEk starts before the first period P1 and may stop after the third period P3 as in FIG. 5.

In the periods P1, P2, and P3 in which the emission control signal SEk is supplied, since the fifth pixel transistor Tp5, the sixth pixel transistor Tp6, the eleventh pixel transistor Tp11, and the twelfth pixel transistor Tp12 maintain off states, the first pixel PXL1 and the second pixel PXL2 may maintain non-emission states.

The first scan signal SSk−1 may be supplied in the first period P1. Therefore, since the fourth pixel transistor Tp4 is turned on in the first period P1, a gate electrode of a driving transistor (for example, the first pixel transistor Tp1) in the first pixel PXL1 may be initialized to the initializing voltage VINT.

In addition, since the tenth pixel transistor Tp10 is turned on in the first period P1, a gate electrode of a driving transistor (for example, the seventh pixel transistor Tp7) in the second pixel PXL2 may be initialized to the initializing voltage VINT. In the first period P1, the first control transistor Tc1 of first pixel PXL1 may maintain an on state.

The first data control signal Cd1 may be supplied in a partial period R1 (hereinafter, referred to as a first sub-period) in the first period P1.

Therefore, in the first sub-period R1, the first data transistor Td1 of the demultiplexer 50 maintains an on state and a first data signal Dt1 of the first data input line O1 may be output to the first data output line D1 through first data transistor Td1.

In the first sub-period R1, since the first control transistor Tc1 also maintains an on state, the first data signal Dt1 may be stored in the first storage capacitor Cs1. At this time, the data driver 30 may supply the first data signal Dt1 to the first data input line O1 in the first sub-period R1.

The second period P2 exists between the first period P1 and the third period P3. The second data control signal Cd2 may be supplied in a partial period R2 (hereinafter, referred to as a second sub-period) in the second period P2 and a partial period R3 (hereinafter, referred to as a third sub-period) in the third period P3.

Therefore, in the second sub-period R2 and the third sub-period R3, the second data transistor Td2 of the demultiplexer 50 maintains an on state and a second data signal Dt2 of the first data input line O1 may be output to the second data output line D2 through the second data transistor Td2. At this time, the data driver 30 may supply the second data signal Dt2 to the first data input line O1 in the second sub-period R2 and the third sub-period R3.

The second scan signal SSk may be supplied in the third period P3. As the second scan signal SSk is supplied, the second pixel transistor Tp2 is turned on and the first data signal Dt1 stored in the first storage capacitor Cs1 may be supplied to the first pixel circuit PC1. At this time, since the third pixel transistor Tp3 is also turned on, a value obtained by subtracting a threshold voltage of the first pixel transistor Tp1 from the first data signal Dt1 is supplied to the third node N3 and the first pixel capacitor Cp1 may store a voltage supplied to the third node N3.

In addition, as the second scan signal SSk is supplied, the eighth pixel transistor Tp8 is turned on and the second data signal Dt2 of the second data output line D2 may be supplied to the second pixel circuit PC2. At this time, since the ninth pixel transistor Tp9 is also turned on, a value obtained by subtracting a threshold voltage of the second pixel transistor Tp2 from the second data signal Dt2 is supplied to the sixth node N6 and the second pixel capacitor Cp2 may store a voltage supplied to the sixth node N6.

When supply of the emission control signal SEk stops, since the fifth pixel transistor Tp5 and the sixth pixel transistor Tp6 are turned on, the first pixel transistor tp1 may supply a driving current corresponding to the voltage stored in the first pixel capacitor Cp1 to the first OLED OLED1. Therefore, the first pixel PXL1 may emit light with corresponding brightness.

In addition, when the supply of the emission control signal SEk stops, since the eleventh pixel transistor Tp11 and the twelfth transistor Tp12 are turned on, the seventh pixel transistor Tp7 may supply a driving current corresponding to the voltage stored in the second pixel capacitor Cp2 to the second OLED OLED2. Therefore, the second pixel PXL2 may emit light with corresponding brightness.

Since the first pixel PXL1 includes the first storage circuit SC1 that may previously store the first data signal Dt1 based on the first scan signal SSk−1, the first data control signal Cd1 may be supplied while overlapping the first scan signal SSk−1.

In some display devices, the first data control signal Cd1 does not overlap the scan signals SSk−1 and SSk. As a result, the supply period of the scan signals SSk−1 and SSk may be relatively short. In accordance with the present embodiment, since tje supply period of the first data control signal Cd1 may be removed, the supply period of the scan signals SSk−1 and SSk may be relatively long.

Figure 6:
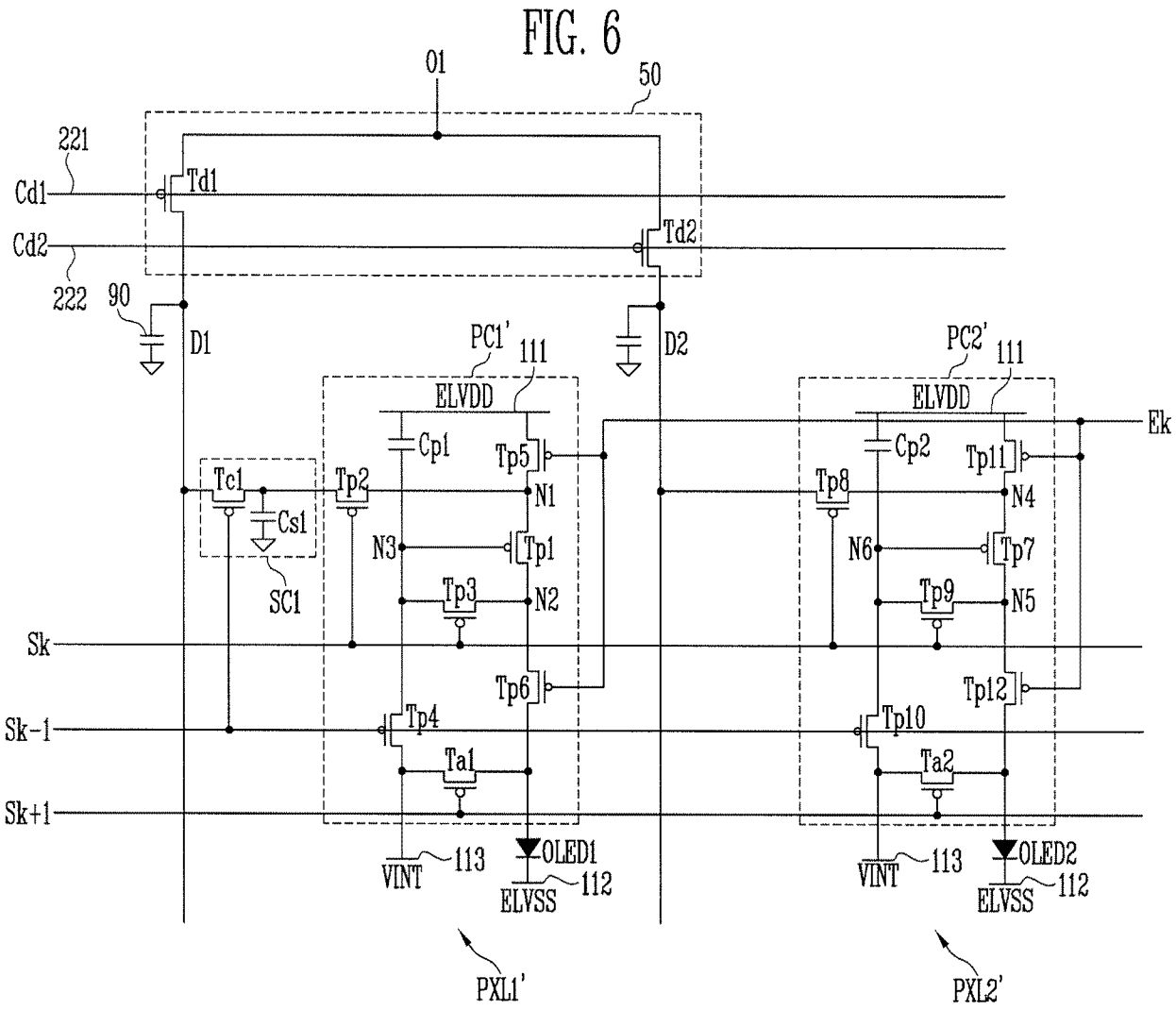
FIG. 6 illustrates an embodiment including multiple pixel circuits.

FIG. 6 illustrates an embodiment which includes a first pixel circuit PC1' and a second pixel circuit PC2'. Referring to FIG. 6, a first pixel PXL1' may include a first additional transistor Ta1. The first pixel circuit PC1' may include the first additional transistor Ta1 connected between the initializing power source 113 and the anode electrode of the first OLED OLED1. For example, the first additional transistor Ta1 may include a first electrode connected to the initializing power source 113, a second electrode connected to the anode electrode of the first OLED OLED1, and a gate electrode connected to a (k+1)th scan line Sk+1.

A second pixel PXL2' may include a second additional transistor Ta2. For example, the second pixel circuit PC2' may include the second additional transistor Ta2 connected between the initializing power source 113 and the anode electrode of the second OLED OLED2. The second additional transistor Ta2 may include, for example, a first electrode connected to the initializing power source 113, a second electrode connected to the anode electrode of the second OLED OLED2, and a gate electrode connected to the (k+1)th scan line Sk+1.

Figure 7:
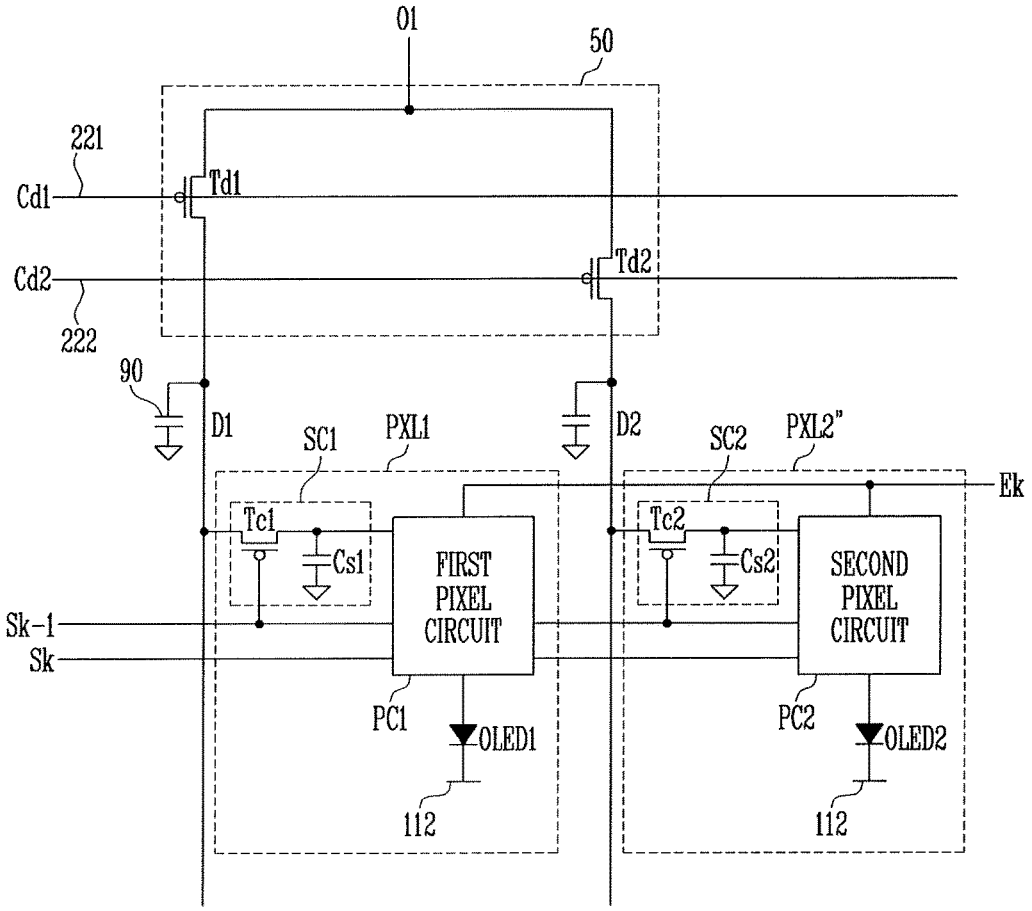
FIG. 7 illustrates another embodiment of a pixel circuit.

FIG. 7 illustrates an embodiment which includes a second pixel PXL2". Referring to FIG. 7, the second pixel PXL2" includes a second storage circuit SC2. In comparison with the second pixel PXL2 of FIG. 3, the second pixel PXL2" includes the second OLED OLED2, the second pixel circuit PC2 and the second storage circuit SC2. The second OLED OLED2 receives a driving current from the second pixel circuit PC2 and emits light with brightness corresponding to the driving current. The second pixel circuit PC2 may supply the driving current corresponding to the second data signal to the second OLED OLED2.

The second storage circuit SC2 is connected to the second data output line D2 and transmits the second data signal supplied by the second data output line D2 to the second pixel circuit PC2. For example, the second storage circuit SC2 may include a second storage capacitor Cs2 and a second control transistor Tc2. The second storage capacitor Cs2 stores the second data signal and may supply the second data signal to the second pixel circuit PC2.

The second control transistor Tc2 is connected to the second data output line D2 and may transmit the second data signal supplied from the second data output line D2 to the second storage capacitor Cs2 when the second transistor Tc2 is turned on. For example, on and off operations of the second control transistor Tc2 may be controlled by the scan signal supplied from the (k−1)th scan line Sk−1.

In this case, a first electrode of the second control transistor Tc2 is connected to the second data output line D2, a second electrode of the second control transistor Tc2 is connected to the second storage capacitor Cs2 and the second pixel circuit PC2, and a gate electrode of the second control transistor Tc2 may be connected to the (k−1)th scan line Sk−1.

Figure 8:
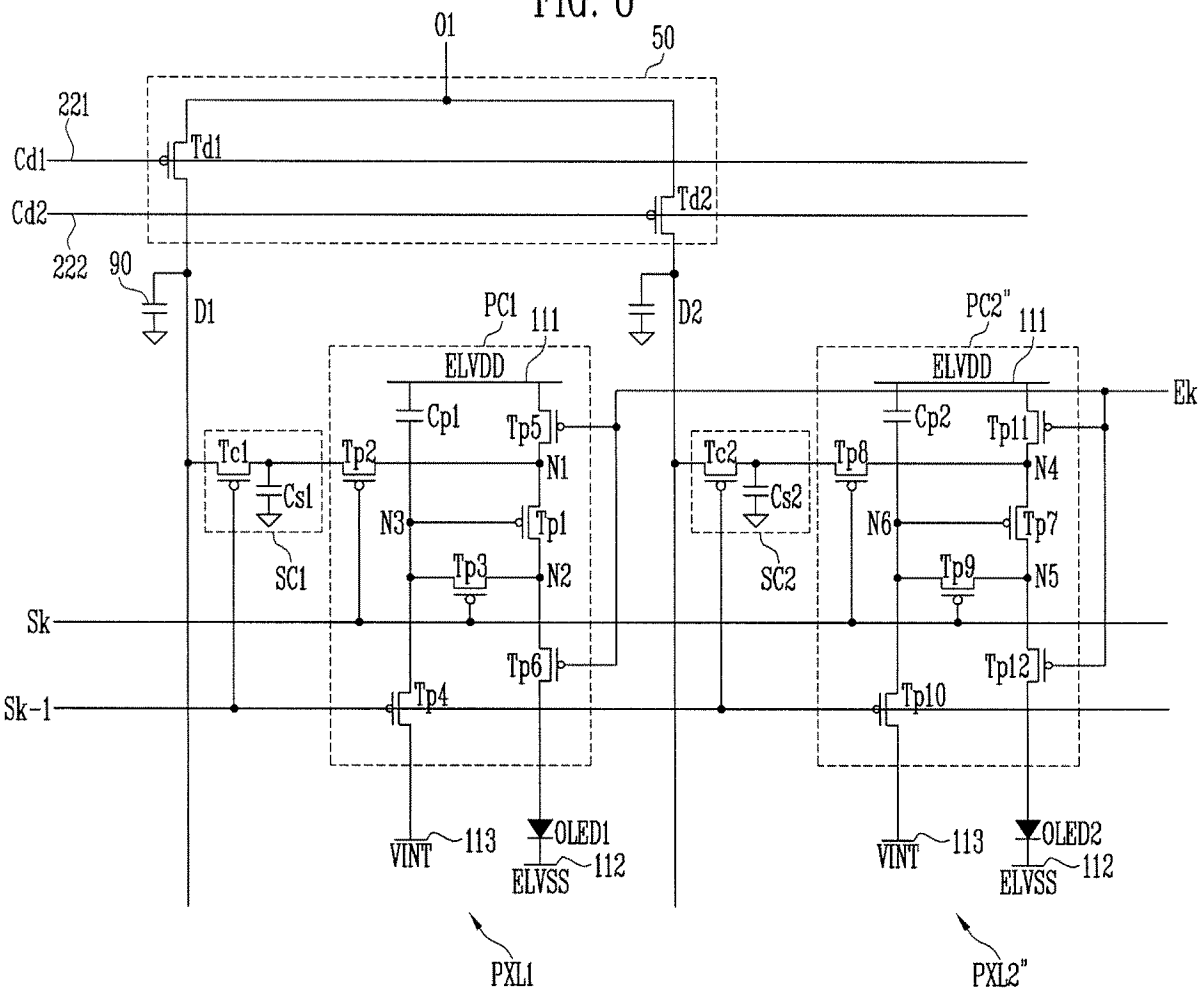
FIG. 8 illustrates a more detailed embodiment of a pixel circuit.

FIG. 8 illustrates an embodiment of a second pixel circuit PC2" which includes a plurality of pixel transistors Tp7 to Tp12 and the second pixel capacitor Cp1. The seventh pixel transistor Tp7 is connected between the fourth node N4 and the fifth node N5 and may have a gate electrode connected to the sixth node N6. For example, the seventh pixel transistor Tp7 may include a first electrode connected to the fourth node N4, a second electrode connected to the fifth node N5, and a gate electrode connected to the sixth node N6.

The eighth transistor Tp8 may be connected between the second control transistor Tc2 in the second storage circuit SC2 and the fourth node N4. For example, the eighth pixel transistor Tp8 may include a first electrode connected to a second electrode of the second control transistor Tc2, a second electrode connected to the fourth node N4, and a gate electrode connected to the kth scan line Sk.

The ninth pixel transistor Tp9 may be connected between the fifth node N5 and the sixth node N6. For example, the ninth pixel transistor Tp9 may include a first electrode connected to the sixth node N6, a second electrode connected to the fifth node N5, and a gate electrode connected to the kth scan line Sk.

The tenth pixel transistor Tp10 may be connected between the sixth node N6 and the initializing power source 113. For example, the tenth pixel transistor Tp10 may include a first electrode connected to the sixth node N6, a second electrode connected to initializing power source 113, and a gate electrode connected to (k−1)th scan line Sk−1.

The eleventh pixel transistor Tp11 may be connected between the fourth node N4 and the first power source 111. For example, the eleventh pixel transistor Tp11 may include a first electrode connected to the first power source 111, a second electrode connected to the fourth node N4, and a gate electrode connected to the kth emission control line Ek.

The twelfth pixel transistor Tp12 may be connected between the fifth node N5 and the second OLED OLED2. For example, the twelfth pixel transistor Tp12 may include a first electrode connected to the fifth node N5, a second electrode connected to the anode electrode of the second OLED OLED2, and a gate electrode connected to the kth emission control line Ek.

The second pixel capacitor Cp2 may be connected between the first power source 111 and the sixth node N6. For example, the second pixel capacitor Cp2 may include a first electrode connected to the first power source 111 and a second electrode connected to the sixth node N6.

The second OLED OLED2 may include the anode electrode connected to the second electrode of the twelfth pixel transistor Tp12, a cathode electrode connected to the second power source 112, and a light emitting layer positioned between the anode electrode and the cathode electrode.

Through the above-described structure, the gate electrode of the first control transistor Tel, the gate electrode of the fourth pixel transistor Tp4, and the gate electrode of the tenth pixel transistor Tp10 may be connected to the same scan line (for example, the (k−1)th scan line Sk−1).

Figure 9:
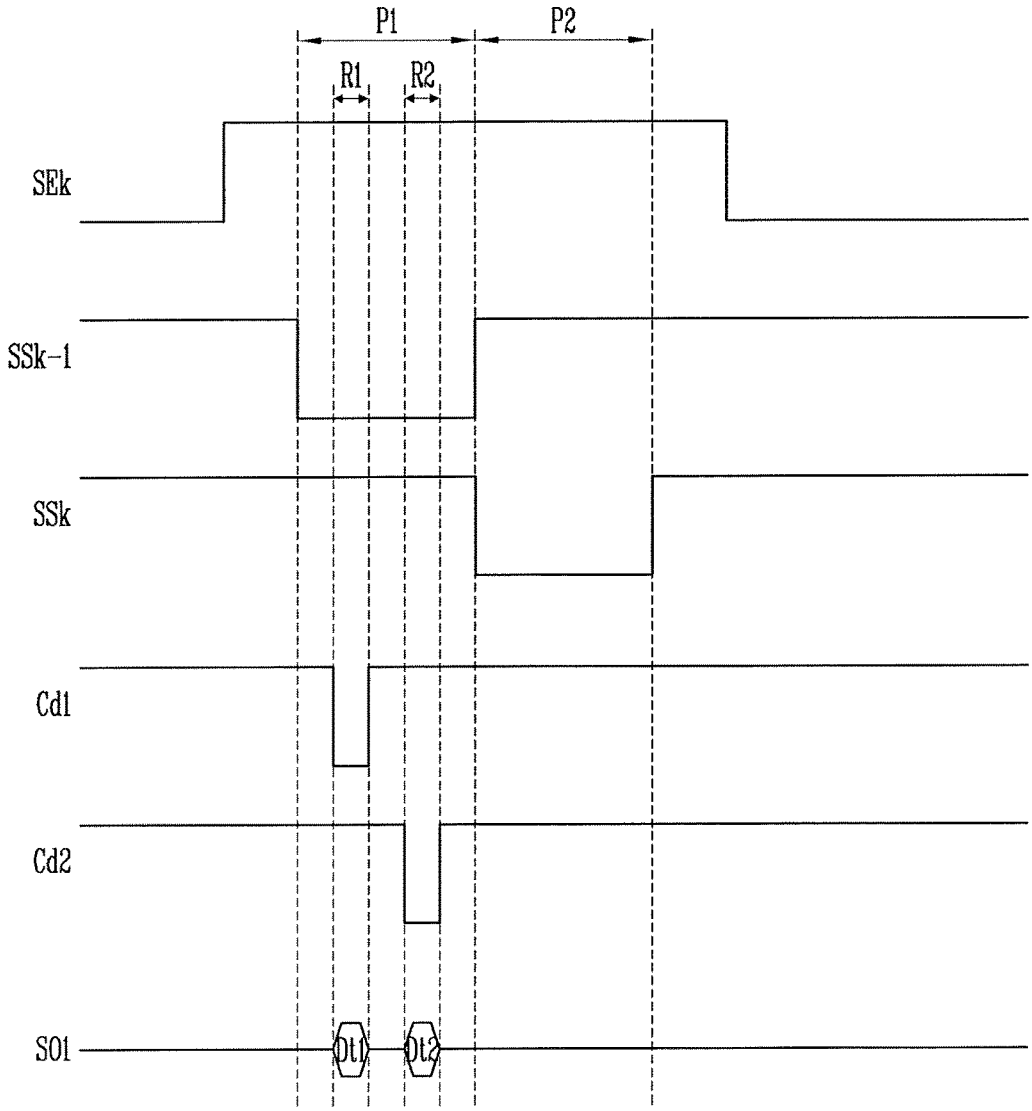
FIG. 9 illustrates another embodiment of a waveform diagram for a display device.

FIG. 9 is another embodiment of a waveform diagram for an organic light emitting display device. Referring to FIGS. 8 and 9, the waveform diagram includes the emission control signal SEk supplied to the kth emission control line Ek, the first scan signal SSk−1 supplied to the (k−1)th scan line Sk−1, the second scan signal SSk supplied to the kth scan line Sk, the first data control signal Cd1, the second data control signal Cd2, and the signal SO1 supplied to the first data input line O1.

The emission control signal SEk may has a voltage to turn off a transistor. For example, when the transistor that receives the emission control signal SEk is a p-type transistor, the emission control signal SEk may have a logically high level voltage. When the transistor that receives the emission control signal SEk is an n-type transistor, the emission control signal SEk may have a logically low level voltage.

The scan signals SSk−1 and SSk and the data control signals Cd1 and Cd2 may have voltages that turn on a transistor. For example, when the transistor that receives the scan signals SSk−1 and SSk and the data control signals Cd1 and Cd2 is a p-type transistor, the scan signals SSk−1 and SSk and the data control signals Cd1 and Cd2 may have logically low level voltages. When the transistor that receives the scan signals SSk−1 and SSk and the data control signals Cd1 and Cd2 is an n-type transistor, the scan signals SSk−1 and SSk and the data control signals Cd1 and Cd2 may have logically high level voltages.

The emission control signal SEk may be supplied in a first period P1 and a second period P2. For example, supply of the emission control signal SEk starts before the first period P1 and may stop after the second period P2 as illustrated in FIG. 9.

In the periods P1 and P2 in which the emission control signal SEk is supplied, since the fifth pixel transistor Tp5, the sixth pixel transistor Tp6, the eleventh pixel transistor Tp11, and the twelfth pixel transistor Tp12 maintain off states, the first pixel PXL1 and the second pixel PXL2 may maintain non-emission states.

The first scan signal SSk−1 may be supplied in the first period P1. Therefore, since the fourth pixel transistor Tp4 is turned on in the first period P1, a gate electrode of a driving transistor (for example, the first pixel transistor Tp1) included in the first pixel PXL1 may be initialized to the initializing voltage VINT.

In addition, since the tenth pixel transistor Tp10 is turned on in the first period P1, a gate electrode of a driving transistor (for example, the seventh pixel transistor Tp7) included in the second pixel PXL2 may be initialized to the initializing voltage VINT.

In the first period P1, the first control transistor Tel of the first pixel PXL1 and the second control transistor Tc2 of the second pixel PXL2 may maintain on states.

The first data control signal Cd1 may be supplied in a partial period R1 (hereinafter, referred to as a first sub-period) in the first period P1.

Therefore, in the first sub-period R1, the first data transistor Td1 of the demultiplexer 50 maintains an on state and a first data signal Dt1 of the first data input line O1 may be output to the first data output line D1 through the first data transistor Td1. In the first sub-period R1, since the first control transistor Tel also maintains an on state, the first data signal Dt1 may be stored in the first storage capacitor Cs1. At this time, the data driver 30 may supply the first data signal Dt1 to the first data input line O1 in the first sub-period R1.

The second data control signal Cd2 may be supplied in another partial period R2 (hereinafter, referred to as a second sub-period) included in the first period P1. Therefore, in the second sub-period R2, the second data transistor Td2 of the demultiplexer 50 maintains an on state and a second data signal Dt2 of the first data input line O1 may be output to the second data output line D2 through the second data transistor Td2.

In the second sub-period R2, since the second control transistor Tc2 also maintains an on state, the second data signal Dt2 may be stored in the second storage capacitor Cs2. At this time, the data driver 30 may supply the second data signal Dt2 to the first data input line O1 in the second sub-period R2.

The second scan signal SSk may be supplied in the second period P2. As the second scan signal SSk is supplied, the second pixel transistor Tp2 is turned on and the first data signal Dt1 stored in the first storage capacitor Cs1 may be supplied to the first pixel circuit PC1.

At this time, since the third pixel transistor Tp3 is also turned on, a value obtained by subtracting a threshold voltage of the first pixel transistor Tp1 from the first data signal Dt1 is supplied to the third node N3 and the first pixel capacitor Cp1 may store a voltage supplied to the third node N3.

In addition, as the second scan signal SSk is supplied, the eighth pixel transistor Tp8 is turned on and the second data signal Dt2 stored in the second storage capacitor Cs2 may be supplied to the second pixel circuit PC2. At this time, since the ninth pixel transistor Tp9 is also turned on, a value obtained by subtracting a threshold voltage of the second pixel transistor Tp2 from the second data signal Dt2 is supplied to the sixth node N6 and the second pixel capacitor Cp2 may store a voltage supplied to the sixth node N6.

When supply of the emission control signal SEk stops, since the fifth pixel transistor Tp5 and the sixth pixel transistor Tp6 are turned on, the first pixel transistor tp1 may supply a driving current corresponding to the voltage stored in the first pixel capacitor Cp1 to the first OLED OLED1. Therefore, the first pixel PXL1 may emit light with a corresponding brightness.

In addition, when the supply of the emission control signal SEk stops, since the eleventh pixel transistor Tp11 and the twelfth transistor Tp12 are turned on, the seventh pixel transistor Tp7 may supply a driving current corresponding to the voltage stored in the second pixel capacitor Cp2 to the second OLED OLED2. Therefore, the second pixel PXL2 may emit light with a corresponding brightness.

Since the first pixel PXL1 and the second pixel PXL2" according to the present embodiment respectively include the first storage circuit SC1 and the second storage circuit SC2 that may previously store the first data signal Dt1 and the second data signal Dt2 in response to the first scan signal SSk−1, the first data control signal Cd1 and the second data control signal Cd2 may be supplied while overlapping the first scan signal SSk−1.

In some display devices, since the first data control signal Cd1 and the second data control signal Cd2 do not overlap the scan signals SSk−1 and SSk, a supply period of the scan signals SSk−1 and SSk is relatively short. According to one or more embodiments, since a supply period of the first data control signal Cd1 and the second data control signal Cd2 may be removed, the supply period of the scan signals SSk−1 and SSk may be secured to be relatively long.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments set forth in the claims.

What is claimed is:

1. A pixel, comprising:

an organic light emitting diode (OLED);

a pixel circuit to provide a driving current corresponding to a data signal to the OLED; and a storage circuit connected between the pixel circuit and a data output line and to provide the data signal to the pixel circuit, wherein the storage circuit includes:

a storage capacitor to store the data signal; and a control transistor including a first electrode connected to the data output line, a second electrode connected to the pixel circuit, and a gate electrode connected to a first scan line for transmitting a first scan signal, wherein the storage capacitor is connected to the second electrode of the control transistor, and wherein the pixel circuit includes:

a first pixel transistor connected between a first node and a second node and having a gate electrode connected to a third node;

a second pixel transistor having a first electrode connected to the second electrode of the control transistor, a second electrode connected to the first node, and a gate electrode connected to a second scan line for transmitting a second scan signal not overlapping the first scan signal; and a pixel capacitor connected between a first power source and the third node, wherein when the first scan signal is supplied to the gate electrode of the control transistor, the control transistor is turned on such that the storage capacitor is charged by the data signal supplied from the data output line through the control transistor being turned on, and when the first scan signal is supplied to the gate electrode of the control transistor, the second pixel transistor is turned off such that the storage capacitor is electrically disconnected from the first pixel transistor and the pixel capacitor by the second pixel transistor being turned off.

2. The pixel as claimed in claim 1, wherein the pixel circuit further includes:

a third pixel transistor connected between the second node and the third node;

a fourth pixel transistor connected between the third node and an initializing power source;

a fifth pixel transistor connected between the first node and the first power source, and having a gate electrode connected to an emission control line; and a sixth pixel transistor connected between the second node and the OLED.

3. The pixel as claimed in claim 2, wherein:

a gate electrode of the fourth pixel transistor is connected to the first scan line, a gate electrode of the third pixel transistor is connected to the second scan line, and a gate electrode of the sixth pixel transistor is connected to the emission control line.

4. The pixel as claimed in claim 2, wherein the OLED includes:

an anode electrode connected to the sixth pixel transistor, and a cathode electrode connected to a second power source.

5. The pixel as claimed in claim 4, wherein the pixel circuit further includes:

a seventh pixel transistor connected between the initializing power source and the anode electrode of the OLED.

6. The pixel as claimed in claim 5, wherein:

the gate electrode of the control transistor and the gate electrode of the fourth pixel transistor are connected to a same first scan line, the gate electrode of the second pixel transistor and the gate electrode of the third pixel transistor are connected to a same second scan line, a gate electrode of the seventh pixel transistor is connected to a third scan line, and the gate electrode of the fifth pixel transistor and the gate electrode of the sixth pixel transistor are connected to a same emission control line.

7. An organic light emitting display device, comprising:

a first pixel connected to a first data output line, an emission control line, a first scan line, and a second scan line;

a second pixel connected to a second data output line, the emission control line, the first scan line, and the second scan line;

an emission control driver to supply an emission control signal to the emission control line;

a scan driver to respectively supply a first scan signal and a second scan signal to the first scan line and the second scan line;

a data driver to supply a first data signal and a second data signal to a data input line; and a demultiplexer to respectively transmit the first data signal and the second data signal from the data input line to the first data output line and the second data output line, wherein the first pixel includes:

a first OLED;

a first pixel circuit to supply a driving current corresponding to the first data signal to the first OLED;

a first storage capacitor to store the first data signal and to supply the first data signal to the first pixel circuit; and a first control transistor connected between the first data output line and the first pixel circuit, the first control transistor including a first electrode connected to the first data output line, a second electrode connected to the first pixel circuit, and a gate electrode connected to the first scan line, wherein the first storage capacitor is connected to the second electrode of the first control transistor, wherein the first pixel circuit includes:

a first pixel transistor connected between a first node and a second node and having a gate electrode connected to a third node;

a second pixel transistor having a first electrode connected to the second electrode of the first control transistor and a second electrode connected to the first node, and a gate electrode connected to the second scan line; and a first pixel capacitor connected between a first power source and the third node, wherein when the first scan signal is supplied to the gate electrode of the first control transistor, the first control transistor is turned on such that the first storage capacitor is charged by the first data signal supplied from the first data output line through the first control transistor being turned on, and when the first scan signal is supplied to the gate electrode of the first control transistor, the second pixel transistor is turned off such that the first storage capacitor is electrically disconnected from the first pixel transistor and the first pixel capacitor by the second pixel transistor being turned off.

8. The display device as claimed in claim 7, wherein the first pixel circuit further includes:

a third pixel transistor connected between the second node and the third node;

a fourth pixel transistor connected between the third node and an initializing power source;

a fifth pixel transistor connected between the first node and the first power source; and a sixth pixel transistor connected between the second node and the first OLED.

9. The display device as claimed in claim 8, wherein the second pixel includes:

a second OLED; and a second pixel circuit connected to the second data output line, the second pixel circuit to receive the second data signal and to supply a driving current corresponding to the second data signal to the second OLED.

10. The display device as claimed in claim 9, wherein the second pixel circuit includes:

a seventh pixel transistor connected between a fourth node and a fifth node and having a gate electrode connected to a sixth node;

an eighth pixel transistor connected between the second data output line and the fourth node;

a ninth pixel transistor connected between the fifth node and the sixth node;

a tenth pixel transistor connected between the sixth node and the initializing power source;

an eleventh pixel transistor connected between the fourth node and the first power source;

a twelfth pixel transistor connected between the fifth node and the second OLED; and a second pixel capacitor connected between the first power source and the sixth node.

11. The display device as claimed in claim 10, wherein:

a gate electrode of the fourth pixel transistor, and a gate electrode of the tenth pixel transistor are connected to the first scan line, a gate electrode of the third pixel transistor, a gate electrode of the eighth pixel transistor, and a gate electrode of the ninth pixel transistor are connected to the second scan line, and a gate electrode of the fifth pixel transistor, a gate electrode of the sixth pixel transistor, a gate electrode of the eleventh pixel transistor, and a gate electrode of the twelfth pixel transistor are connected to a same emission control line.

12. The display device as claimed in claim 11, wherein the demultiplexer includes:

a first data transistor connected between the data input line and the first data output line and turned on in response to a first data control signal; and a second data transistor connected between the data input line and the second data output line and turned on in response to a second data control signal.

13. The display device as claimed in claim 12, wherein:

the emission control signal is to be supplied in a first period, a second period, and a third period, the first scan signal is to be supplied in the first period, the second scan signal is to be supplied in the third period, the first data control signal is to be supplied in a partial period in the first period, and the second data control signal is to be supplied in a partial period in the second period and a partial period in the third period.

14. The display device as claimed in claim 8, wherein the second pixel includes:

a second OLED;

a second pixel circuit to supply a driving current corresponding to the second data signal to the second OLED;

a second storage capacitor to store the second data signal and to supply the second data signal to the second pixel circuit; and a second control transistor connected to the second data output line and to transmit the second data signal from the second data output line to the second storage capacitor when the second control transistor is turned on.

15. The display device as claimed in claim 14, wherein the second pixel circuit includes:

a seventh pixel transistor connected between a fourth node and a fifth node and having a gate electrode connected to a sixth node;

an eighth pixel transistor connected between a second electrode of the second control transistor and the fourth node;

a ninth pixel transistor connected between the fifth node and the sixth node;

a tenth pixel transistor connected between the sixth node and the initializing power source;

an eleventh pixel transistor connected between the fourth node and the first power source;

a twelfth pixel transistor connected between the fifth node and the second OLED; and a second pixel capacitor connected between the first power source and the sixth node.

16. The display device as claimed in claim 15, wherein:

the gate electrode of the first control transistor, a gate electrode of the fourth pixel transistor, a gate electrode of the second control transistor, and a gate electrode of the tenth pixel transistor are connected to a same first scan line, the gate electrode of the second pixel transistor, a gate electrode of the third pixel transistor, a gate electrode of the eighth pixel transistor, and a gate electrode of the ninth pixel transistor are connected to a same second scan line, and a gate electrode of the fifth pixel transistor, a gate electrode of the sixth pixel transistor, a gate electrode of the eleventh pixel transistor, and a gate electrode of the twelfth pixel transistor are connected to a same emission control line.

17. The display device as claimed in claim 16, wherein the demultiplexer includes:

a first data transistor connected between the data input line and the first data output line and turned on in response to a first data control signal; and a second data transistor connected between the data input line and the second data output line and turned on in response to a second data control signal.

18. The display device as claimed in claim 17, wherein:

the emission control signal is to be supplied in a first period and a second period, the first scan signal is to be supplied in the first period, the second scan signal is to be supplied in the second period, the first data control signal is to be supplied in a first sub-period in the first period, and the second data control signal is to be supplied in a second sub-period in the first period.

* * * * *